United States Patent [19]

Holz

[11] 4,202,761

[45] May 13, 1980

[54] SORTING APPARATUS FOR SORTING FIBER SUSPENSIONS

[75] Inventor: Emil Holz, Eningen, Fed. Rep. of Germany

[73] Assignee: Hermann Finckh Maschinenfabrik, Fed. Rep. of Germany

[21] Appl. No.: 887,223

[22] Filed: Mar. 16, 1978

[30] Foreign Application Priority Data

Mar. 23, 1977 [DE] Fed. Rep. of Germany ..... 2712749

[51] Int. Cl.[2] ..... B04C 9/00

[52] U.S. Cl. ..... 209/17; 209/273

[58] Field of Search ..... 209/270, 273, 268, 17

[56] References Cited

U.S. PATENT DOCUMENTS

| | | | |
|---|---|---|---|
| 3,586,172 | 6/1971 | Young | 209/273 |
| 3,677,402 | 7/1972 | Holz | 209/270 |
| 3,939,065 | 2/1976 | Ahlfors | 209/270 |

FOREIGN PATENT DOCUMENTS 1461090 10/1970 Fed. Rep. of Germany .

*Primary Examiner*—Ralph J. Hill

*Attorney, Agent, or Firm*—Leydig, Voit, Osann, Mayer & Holt, Ltd.

[57] ABSTRACT

An apparatus for sorting fiber suspensions comprising a stationary cylindrical screen cage and a rotor having a cylindrical wall mounted concentrically relative to the screen cage to form an annular space, the unsorted fiber suspension entering the annular space at one end and flowing generally toward the other end of the annular space, the fiber suspension increasing in consistency as it flows toward the other end of the annular space, the rotor having openings and/or elevations to cause the dilution of at least a portion of the thickened stock in the annular space not passing through the screen with a portion of lower consistency fibrous suspension to allow it to flow more readily. In one embodiment the rotor is mounted within the screen cage and a portion of the unsorted fiber suspension is introduced to the interior of the rotor, passing outwardly through openings in the rotor along the length of the annular space to dilute the thickened, dewatered suspension within the annular space.

19 Claims, 5 Drawing Figures

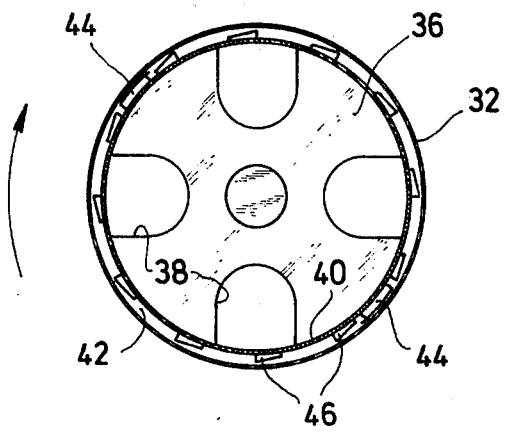
Fig. 2
Fig. 3
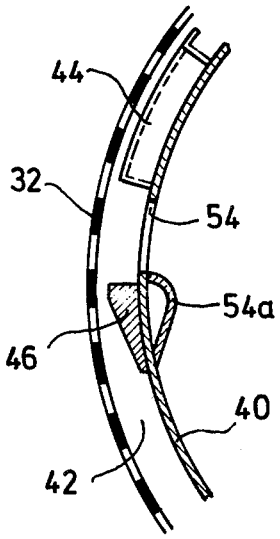
Fig. 4
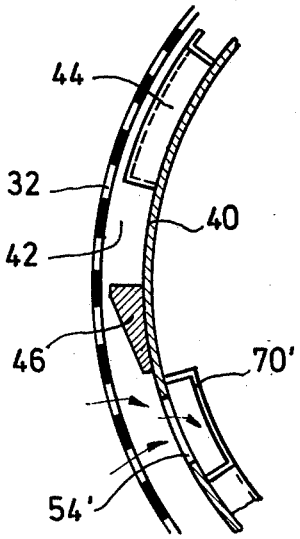

SORTING APPARATUS FOR SORTING FIBER SUSPENSIONS

The invention relates to a sorting apparatus for sorting fiber suspensions comprising a stationary screen cage and a rotor mounted concentrically therein, an inlet area for the fiber suspension to be sorted which flows through the screen cage from the inside to the outside located at one end of the screen cage, and an outlet area for the rejected stock, i.e., the part of the fiber suspension that cannot pass through the openings in the screen cage, located at the other end of the screen cage.

Such sorting apparatuses are employed particularly in the manufacture of paper, preferably in the form of so-called pressure sorting apparatuses, which are closed devices into which the fiber suspension to be sorted is introduced under pressure.

In sorting apparatuses of the first aforementioned kind, the flow of the fiber suspension to be sorted from one end of the screen cage to the other is of helical configuration owing to the rotation of the rotor and the part of the fiber suspension located in the interior of the screen cage becomes thicker and thicker as most of the water passes through the openings in the screen cage together with the good fibers. Not only are dirt and other non-fibrous components of the suspension retained, but also conglomerations of fibers, and the rejected stock is therefore often further processed so as not to have to discard the fibers contained therein. The relatively high consistency of the rejected stock does, however, often make it difficult for it to be conveyed through pipe lines, and in sorting apparatuses wherein the rotor comprises a closed cylindrical circumferential wall, the annular space between the screen cage and the rotor must be relatively wide so that clogging of the annular space does not occur at the outlet end of the rotor as a result of the high density of the rejected stock. Since the circumferential walls of such rotors are provided with so-called clearing strips or cleaning blades which are ridges or strips extending over the entire length of the rotor approximately in axial direction and serving to produce in the proximity of the screen cage, in the direction of rotation of the rotor, pressure thrusts in front of the strips and negative pressure thrusts behind the strips, so as to obtain a kind of reversed flushing effect in the openings in the screen cage and thereby avoid clogging of the openings in the screen cage, a wide annular space between the screen cage and the rotor has the disadvantage that relatively high clearing strips or cleaning blades are required, which cause vibrations in the accepted stock, i.e., in the fiber suspension passing through the screen cage, and such vibrations result in undesired irregularities in the sheet formation. Moreover, the greater the height of the clearing strips or cleaning blades, the greater is the amount of power required to drive a rotor.

Water could, of course, be added to the rejected stock in order to dilute it. However, this would not only be disadvantageous in view of the additional water needed, but also because of the higher power requirement, since diluting water must be introduced into a pressure sorting apparatus under pressure and this necessitates pumping power.

The object of the invention was therefore to construe a sorting apparatus of the first aforementioned kind, wherein the difficulties created hitherto by the high density of the rejected stock are avoided in a more economical manner. The basic concept of the invention was to dilute the rejected stock or the fiber suspension in those areas where it otherwise reaches a relatively high density with fiber suspension which is still to be sorted or has already been sorted, thereby reducing the consistency again. Dilution is preferably effected using fiber suspension which is still to be sorted. Structurally, this basic concept can be realized in accordance with the invention in a sorting apparatus of the first aforementioned kind, by providing means for introducing fiber suspension for the purpose of diluting the rejected stock at least in the proximity of the outlet area for the rejected stock.

In a preferred embodiment of the inventive sorting apparatus comprising a rotor with a substantially closed circumferential wall and an annular space between the stationary screen cage and the circumferential wall of the rotor into which the suspension to be sorted can be introduced, the circumferential wall of the rotor has at least in the proximity of the outlet area at least one opening which communicates with the inlet area. Conduits or feed pipes could be connected to these openings, but the easiest way is for the rotor to have at the end adjacent the inlet area an opening for the introduction of fiber suspension to be sorted into the interior of the rotor. Since the fiber suspension in the interior of the rotor is rotated by the rotor, the centrifugal forces convey the fiber suspension through the openings into the annular space. By a corresponding distribution of the openings along the circumferential wall of the rotor and a suitable choice of the number and size of the openings, the stock density can be selected at any point in the annular space so as to eliminate clogging. If only dilution of the rejected stock were required, it would be sufficient to provide in the end wall of the rotor facing the outlet area one or several openings through which fresh fiber suspension flows out. The best results are, however, obtained from a rotor having both end walls open and comprising a suitable number, size and arrangement of openings in the circumferential wall, so that the fiber suspension to be sorted reaches the screen cage both along the annular space and via the rotor interior and the openings in the circumferential wall of the rotor, as the centrifugal forces are sufficient to ensure that the fiber suspension is conveyed through the openings into the annular space. The part of the fiber suspension flowing out of the rotor at the outlet end thereof simultaneously dilutes the rejected stock flowing out of the sorting apparatus. Owing to the possibility of making the annular space narrower, without having to risk the danger of clogging, the inventive sorting apparatus also requires less power to drive the rotor, as lower clearing or cleaning blades are sufficient.

As stated, elevations on the circumferential wall of the rotor serve to produce positive and negative pressure thrusts in the annular space and in order not to impair the performance of the negative pressure thrusts creating the reverse flushing effect at the openings in the screen cage by fiber suspension being introduced into the annular space through the circumferential wall of the rotor for the purpose of dilution, it is advisable to arrange the openings in the circumferential wall of the rotor in front of the elevations, in the direction of rotation of the rotor, as the negative pressure thrusts occur behind the elevations.

In another embodiment of the inventive sorting apparatus, the openings in the circumferential wall of the rotor are used for removal of the rejected stock from the annular space between the screen cage and the circumferential wall of the rotor through the latter in those areas of the annular space where the suspension has already reached a very thick consistency. It is therefore not necessary for the thickened suspension to flow through the entire length of the annular space. The part of the rejected stock which is drawn into the interior of the rotor is simultaneously replaced by fiber suspension of a lower stock density, which flows back through the screen cage from the outside to the inside and thereby dilutes the fiber suspension in the annular space. This concept is achieved structurally by the circumferential wall of the rotor comprising openings at least in the proximity of the outlet area which communicate with the outlet area. The part of the rejected stock which is removed from the annular space through the circumferential wall of the rotor is therefore conveyed directly to the outlet area. In sorting apparatuses comprising elevations on the circumferential wall of the rotor for producing positive and negative pressure thrusts in the annular space, it is advisable in this connection to arrange the openings in the circumferential wall of the rotor serving to remove the rejected stock from the annular space behind the elevations, in the direction of rotation of the rotor, i.e., in the region of the negative pressure thrusts which have the effect of drawing suspension which has already been sorted back through the openings in the screen cage into the annular space, so that the rejected stock which is withdrawn via the openings in the circumferential wall of the rotor is automatically replaced by fiber suspension of low stock density.

In order to avoid fiber conglomerations at the, in the direction of rotation, rear edges of the openings in the circumferential wall of the rotor, these edges are rounded off by mounting on the inside of the circumferential wall of the rotor elevations of rounded off configuration, and preferably airfoil cross-section, which adjoin, in the direction of rotation, the rear edges of the openings.

It was already pointed out that the invention enables the annular space to be made narrower and the clearing strips or cleaning blades less high than in known sorting apparatuses, thereby obtaining less vibrations in the accepted stock outlet of the sorting apparatus. These annoying vibrations can then be further decreased by mounting on the circumferential wall of the rotor several elongated elevations which extend approximately in axial direction, correspond in length to a fraction of the length of the circumferential wall of the rotor and are placed in staggered arrangement in the circumferential direction, instead of continuous strips or blades. If an inventive sorting apparatus is located directly in front of a paper machine, this measure decreases irregularities in the sheet formation to a considerable extent.

To aid transportation of the rejected stock in the direction of the outlet area it can, however, be expedient to arrange on the circumferential wall of the rotor several—preferably two—elevations extending substantially over the entire length of the rotor at an incline to the rotor axis such that they convey the fiber suspension or the rejected stock in the annular space in the direction of the outlet area.

The invention is suitable for all sorting apparatuses, but particularly for those wherein the screen cage is comparatively long.

The fiber suspension to be processed is often circulated at a high rotational speed in a so-called vortex cleaner where impurities of relatively high and relatively low specific gravity which are typical of fiber suspensions acquired from waste paper, for example, paper clips and other pieces of metal, such as foamed plastic particles and the like, are separated out before entering a sorting apparatus. The particles of relatively high specific gravity are removed at the bottom of the vortex cleaner, while the particles of relatively low specific gravity rise together with air contained in the fiber suspension in the center of the vortex cleaner. In known systems consisting of a sorting apparatus and a vortex cleaner, as described, for example, in the German published patent application No. 1,461,090, the rotor of the sorting apparatus which is closed at the bottom causes the dirt particles of relatively low specific gravity and the air to be conveyed into the annular space between the circumferential wall of the rotor and the screen cage when they hit the bottom of the rotating rotor. As far as the dirt particles of relatively low specific gravity are concerned, this is of no further disadvantage as these cannot pass through the openings in the screen cage. However, in this way the air which has already been separated from the suspension escapes through the openings in the screen cage into the accepted stock, and air contained in the fiber suspension impairs sheet formation in a paper machine. According to the invention a sorting apparatus comprising a rotor with a vertical axis and a vortex cleaner into which the fiber suspension to be sorted can be introduced mounted under the rotor at least approximately coaxially therewith, is constructed such that the rotor comprises a channel which has a port located above the center of the vortex cleaner and flows into a rejected stock area comprising the outlet area. In this way not only the rejected stock is diluted by a supply of fresh fiber suspension, but the air bubbles and dirt particles of low specific gravity rising in the center of the vortex cleaner are at the same time caught and removed through the channel directly into the rejected stock area, and so they cannot reach the inside of the screen.

Further features, details and advantages of the invention can be found in the following specification and the enclosed drawings of three preferred embodiments of inventive pressure sorting apparatuses.

FIG. 2 is a section through the screen cage and the rotor of this pressure sorting apparatus taken along line 2—2 in FIG. 1.

FIG. 3 is a section through part of the rotor and the screen cage taken along line 3—3 in FIG. 1, however, on an enlarged scale.

FIG. 4 is a section corresponding to FIG. 3 through a second embodiment of an inventive pressure sorting apparatus.

Figure 1:
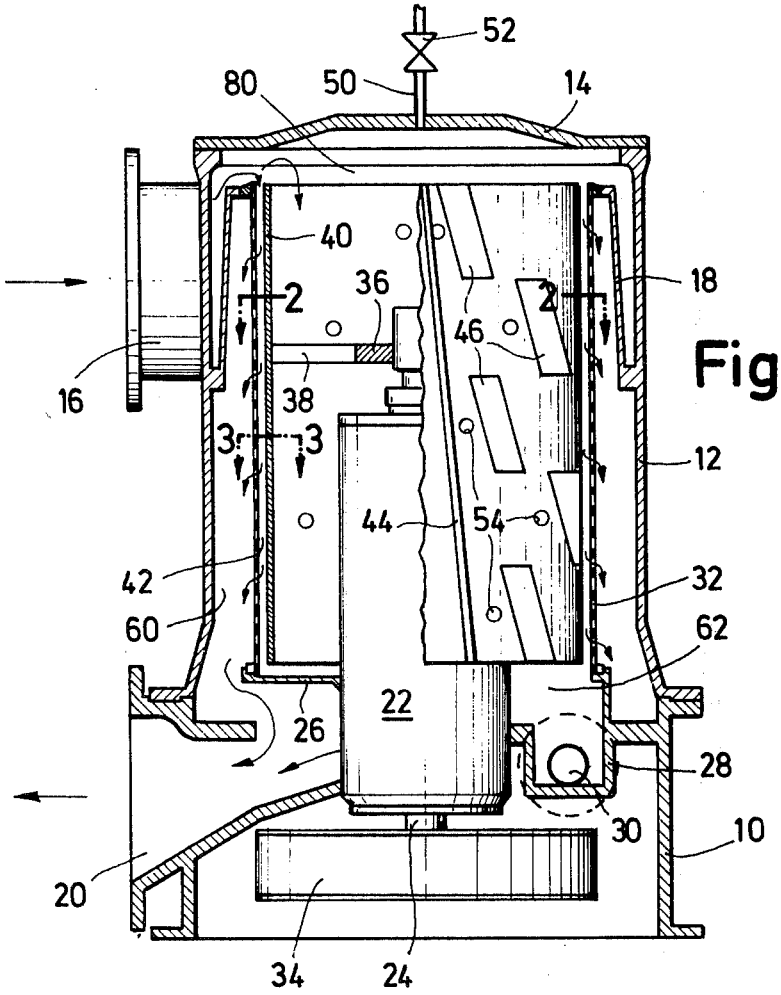
FIG. 1 is a vertical section through a first embodiment of an inventive pressure sorting apparatus.

The pressure sorting apparatus shown in FIGS. 1 to 3 comprises a casing consisting of a base portion 10, a circumferential wall 12 and a cover 14. An inlet nozzle 16 for the fiber suspension to be sorted is located at the circumferential wall 12, and an annular wall 18 over which the fiber suspension flowing into the pressure sorting apparatus must flow forms an integral part of the inside of the circumferential wall 12 in the region of the inlet nozzle 16.

An outlet nozzle 20 for the so-called accepted stock is located at the base portion 10 of the casing, which holds a bearing support means 22 in which an axis 24 is mounted for rotation. A separation wall 26 mounted in the base portion of the casing and surrounding the support bearing means 22 forms a so-called rejected stock gutter 28 which opens into an outlet nozzle 30 for the rejected stock forming an integral part of the base portion 10 of the casing. On this separation wall there rests a screen cage 32 which is mounted concentrically with the axis 24 and extends to the upper end of the annular wall 18. This screen cage is a closed hollow cylindrical screening plate with circular or slit-shaped screen openings.

A pulley 34 via which the axis 24 can be driven is secured at the bottom of this axis. A supporting disc 36 comprising substantially U-shaped recesses 38 and carrying a rotor 40 formed by a hollow circular cylinder is secured at the top of the axis. The rotor is approximately the same height as the screen cage 32 and so a relatively narrow annular space 42 is formed between these two parts. On the surface of its circumferential wall the rotor comprises two opposite clearing strips 44 (see FIG. 2) which extend over the entire length of the rotor and are slightly inclined relative to its longitudinal axis such that they cause a conveying effect from the top to the bottom upon rotation of the rotor in the direction of the arrow. The circumferential wall of the rotor also comprises several short cleaning blades 46 having a wedge-shaped cross-section, as shown in FIG. 3, and likewise being slightly inclined are mounted in staggered arrangement in the circumferential direction. The rotor of the inventive sorting apparatus is open at the top and the bottom.

The cover 14 is provided with a ventilation nozzle 50 comprising a valve 52.

The embodiment of the inventive pressure sorting apparatus shown in FIGS. 1 to 3 comprises openings 54 in the circumferential wall of the rotor which, in the direction of rotation, are arranged in front of the cleaning blades 46. Under certain circumstances it may be expedient, in contrast to the drawings, to select the openings in the lower region of the circumferential wall of the rotor such that they are greater in number or diameter than those in the upper region of the rotor.

The fiber suspension to be processed flows through the inlet nozzle 16 and over the annular wall 18 partly into the annular space 42 between the rotor and the screen cage and partly into the interior of the rotor which is open at the top. Water and good fibers are pressed through the openings in the screen cage into an accepted stock area 60 between the screen cage and the circumferential wall 12 of the casing by the centrifugal forces produced by rotation of the rotor, and the accepted stock flows through between the separation wall 26 and the upper wall of the outlet nozzle 20 down into the outlet nozzle. Owing to the force of gravity and the inclined position of the clearing strips 44 and the cleaning blades 46, the fiber suspension moves downwardly in helical shaped paths within the annular space 42 and would become thicker and thicker if it were not continuously supplied with fresh fiber suspension via the openings 54 in the circumferential wall of the rotor. In this way the so-called rejected stock, i.e., the part of the fiber suspension which cannot pass through the openings in the screen cage 32 is prevented from thickening to too great an extent in the lower part of the annular space 42. Furthermore, in spite of the centrifugal forces a small part of the fiber suspension flowing in from the top to the interior of the rotor reaches the rejected stock area 62 via the separation wall 26, since the rotor 40 is also open at the bottom and so the rejected stock is diluted here once again and can consequently be removed without any difficulty through the pipe line connected to the outlet nozzle 30. Although a positive pressure exists in front of the cleaning blades 46 the centrifugal force is sufficient to force the fiber suspension out of the interior of the rotor into the annular space 42 through the openings 54.

In order to avoid conglomerations of fibers at the, in the direction of rotation, rear edges of the openings 54, formed sheet metal members **54*a* are welded to the inside of the rotor 40, thereby eliminating sharp edges. It is then expedient to design the openings 54 such that they have a straight rear edge to which the formed sheet metal members 54*a*** can be connected. In the preferred embodiment these formed sheet metal members have an airfoil-like cross-section.

The second embodiment shown in FIG. 4 differs from the first embodiment shown in FIGS. 1 to 3 solely in that openings 54' in the circumferential wall of the rotor are not arranged in front of, but rather behind the cleaning blades 46. Furthermore, U-shaped channels 70' extending at an incline in a downward direction, so that one channel is associated with all openings 54' arranged behind one group of cleaning blades 46 placed approximately above each other, are secured to the inside of the circumferential wall of the rotor. Since a negative pressure exists behind these cleaning blades fiber suspension flows from the accepted stock area 60 back into the annular space 42, and owing to the inclination of the channels 70' corresponding to the inclination of the cleaning blades 46, the rejected stock flushed into the openings 54' by the good fiber suspension is removed in a downward direction. In this embodiment of the inventive pressure sorting apparatus it is expedient to provide openings 54' only in the lower area of the circumferential wall of the rotor so as not to convey too much accepted stock into the rejected stock area 62 via the channels 70'.

Reference is made in the enclosed claims to an inlet area and an outlet area, the former being the area 80 between cover 14 on the one hand, and rotor 40 and screen cage 32 on the other hand, and the latter being the rejected stock area 62.

Figure 5:
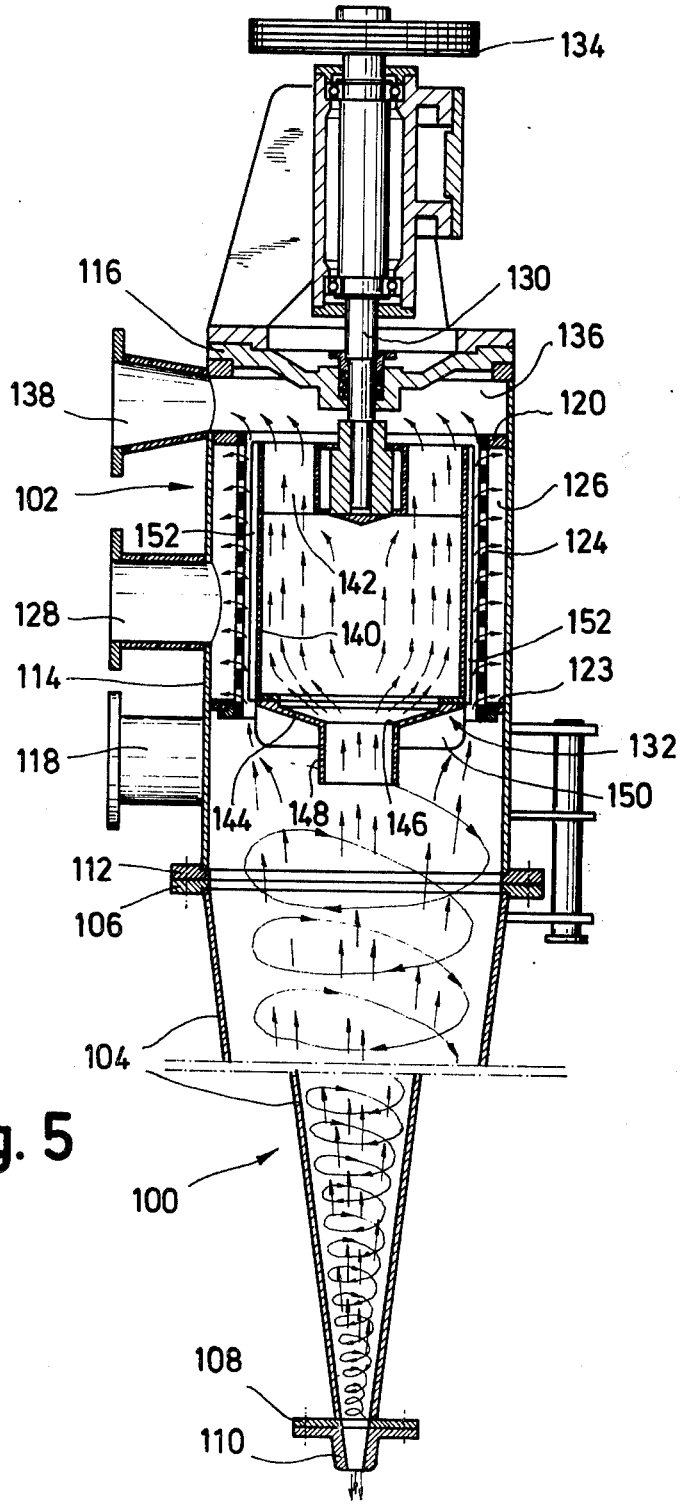
FIG. 5 is a vertical section through a pressure sorting apparatus combined with a so-called vortex cleaner.

The apparatus shown in FIG. 5 is a combination of a vortex cleaner 100 and a pressure sorting apparatus 102. The vortex cleaner comprises a conical casing 104 with an upper and a lower flange 106 and 108, respectively. In the embodiment shown a nozzle 110 is connected to the lower flange. A chamber with an outlet valve could also be used instead of this nozzle. The upper flange 106 is connected to the circumferential wall 114 of the casing of the pressure sorting apparatus 102 via a flange 112. The pressure sorting apparatus is closed at the top by a cover 116. An inlet nozzle 118 extending in a tangential direction through which the fiber suspension to be processed is introduced into the apparatus is mounted at the circumferential wall 114 of the casing. The inlet nozzle is to be connected to the rear half of the circumferential wall 114 of the casing, as shown in FIG. 5, so that—seen from above—the fiber suspension introduced into the apparatus under pressure circulates in clockwise direction.

A cylindrical screen cage 124 which is traversed by the fiber suspension to be processed flowing from the inside to the outside is secured within the pressure sorting apparatus by two rings 120 and 123. An accepted stock area 126 into which an accepted stock outlet nozzle 128 opens is therefore located between the screen cage and the circumferential wall 114 of the casing.

An axis 130 which supports a rotor designated in its entirety 132 and can be driven via a pulley 134 is mounted for rotation in the cover 116. Between the rotor 132 and the cover 116 the pressure sorting apparatus comprises a so-called rejected stock area 136, into which a rejected stock outlet nozzle 138 opens.

The rotor comprises a closed cylindrical circumferential wall 140 which is supported by the axis 130 via several carrier arms 142 extending in a radial direction. The rotor 132 is open at the top. A truncated cone shaped base 144 comprising a central opening 146 to which a downwardly extending nozzle 148 is connected, is secured to the bottom of the circumferential wall 140 of the rotor. Blades 150 extending in a radial direction are secured to the base 144. However, in accordance with the invention the nozzle 148 extends downwardly beyond the blades. Clearing strips 152 are attached to the circumferential wall of the rotor and are inclined relative to the rotor axis such that rotation of the rotor produces an upward conveying effect—seen from above—in clockwise direction in the annular space between the screen cage 124 and the circumferential wall 140 of the rotor.

The fiber suspension to be processed reaches the region of the rotating blades 150 behind the inlet nozzle 118 and these intensify circulation further. As indicated, the suspension then flows downwardly in a helical shaped path in the vortex cleaner 100 and impurities of relatively high specific gravity are separated due to the centrifugal forces and sink downwardly on the inside of the casing 104 of the vortex cleaner arriving finally at the nozzle 110 where they float out of the vortex cleaner together with a small amount of the suspension. Simultaneously air bubbles and dirt particles of relatively low specific gravity such as foamed plastic particles arrive at the center of the vortex cleaner where they move upwardly again together with most of the fiber suspension. The dirt particles of relatively low specific gravity and the air bubbles are then picked up by the nozzle 148 of the rotor together with a relatively small amount of the fiber suspension, while the majority of the rising fiber suspension is conducted through the base 144 of the rotor into the annular space between the circumferential wall of the rotor and the screen cage, inter alia, also by the effect of the rotating blades 150. The majority of the water leaves this annular space together with the good fibers through the openings in the screen cage and reaches the accepted stock outlet nozzle 128, while conglomerations of fibers and dirt which has not been separated off in the vortex cleaner are conveyed into the rejected stock area 136 by the clearing blades 152. There the rejected stock is diluted by the part of the fiber suspension which flows upwardly through the interior of the rotor and takes the air bubbles and dirt particles of relatively low specific gravity along with it. Thus, in the apparatus shown in FIG. 5 not only the rejected stock is diluted in accordance with the invention, but gases are also simultaneously removed from the fiber suspension in an effective manner. Finally, dirt particles of relatively low specific gravity do not have to pass through the comparatively narrow annular space between the screen cage and the circumferential wall of the rotor.

If the removal of gases is not required at all, or only partly, the apparatus shown in FIG. 5 can, of course, be adapted to have openings in the circumferential wall 140 of the rotor so that the rejected stock is already diluted in the annular space between the screen cage and the circumferential wall of the rotor.

The apparatus shown in FIG. 5 is a construction with a relatively long and thin vortex cleaner which is particularly well suited for use in the so-called low consistency range.

The amount of fiber suspension supplied directly to the rejected stock area 136 via the interior of the rotor can be adjusted by an outlet valve (not shown) on the outlet nozzle 138.

In principle, the invention could also be applied to sorting apparatuses wherein a stationary screen cage is traversed by the suspension to be sorted flowing from the outside to the inside, and is surrounded by a rotor comprising a substantially closed cylindrical circumferential wall, whereby an annular space for retaining the rejected stock is formed between the screen cage and the circumferential wall of the rotor. In order to dilute the rejected stock one could then, for example, introduce part of the suspension to be sorted into the annular space through openings in the circumferential wall of the rotor.

I claim:

1. An apparatus for sorting fiber suspensions comprising:

a stationary cylindrical screen cage;

a rotor having a cylindrical wall mounted concentrically relative to the screen cage, the screen cage and said rotor forming an annular space therebetween;

an inlet for fiber suspension to be sorted, the inlet being in flow communication with one end of said annular space to introduce at least a first portion of the fibrous suspension to be sorted into said one end of the annular space, the fibrous suspension within the annular space flowing generally toward the other end of said annular space, a portion of the suspension within the annular space passing through the screen cage as accepted stock, the suspension within the annular space and that passing from said other end thereof being unaccepted stock, the action of the rotor causing the unaccepted stock within the annular space to increase in consistency as it flows toward said other end of the annular space;

an accepted stock outlet in flow communication with the side of said screen cage opposite the annular space; and an unaccepted stock outlet in flow communication with at least said other end of the annular space, the apparatus further comprising means connecting the inlet directly to the other end of the annular space for introducing fibrous suspension to be sorted into the thickened unaccepted stock at the other end of the annular space to reduce the consistency of the latter to facilitate its conveyance to the unaccepted stock outlet.

2. The apparatus of claim 1, the rotor being mounted concentrically within the screen cage, the passage comprising the interior of the rotor.

3. The apparatus of claim 1, the rotor further comprising portions of the rotor forming openings, the openings being in flow communication with the unaccepted stock outlet, and elevations on the side of the cylindrical wall of the rotor facing the annular space, the elevations being arranged, in the direction of rotation, in front of the openings, the elevations producing negative pressure thrusts in the area of the openings to simultaneously cause (a) the return flow of accepted stock back through the screen cage into the annular space to dilute the unaccepted stock and (b) the flow of diluted unaccepted stock from the annular space through the openings.

4. The apparatus of claim 1, the inlet for fiber suspension to be sorted further being in flow communication with the side of the cylindrical wall of the rotor opposite the annular space, the rotor further comprising portions forming openings in at least a portion of the cylindrical wall of the rotor, a further portion of the fibrous suspension to be sorted being introduced to the side of the rotor opposite the annular space and passing through the openings in the rotor into the annular space to dilute the unaccepted stock in the annular space to a lower consistency.

5. The apparatus of claim 1, the rotor further comprising elevations on the cylindrical wall of the rotor facing the annular space for producing positive and negative pressure thrusts in the annular space, the elevations being arranged, in the direction of rotation, behind the openings in the rotor wall.

6. The apparatus of claim 5, the portions of the rotor defining openings and the associated elevations being arranged longitudinally and circumferentially around the wall of the rotor in a staggered relationship, the elevations extending approximately axially and having a length a fraction of that of the rotor.

7. The apparatus of claim 4, the rotor further comprising elevations on the side of the cylindrical wall opposite the annular space, the elevations having an air-foil configuration and being arranged, in the direction of rotation, immediately behind the openings in the rotor wall to inhibit the formation of conglomerations of fibers at the edges of the openings.

8. The apparatus of claim 4, the rotor being mounted concentrically within the screen cage, fibrous suspension to be sorted being introduced directly to the interior of the rotor and passing outwardly through the openings in the rotor into the annular space.

9. The apparatus of claim 1 further comprising elevations arranged over substantially the entire length of the rotor and inclined relative to the rotor axis for causing the fibrous suspension within the annular space to flow from the one end toward the other end thereof.

10. The apparatus of claim 9, the elevations having a maximum height of 10 to 15 millimeters.

11. The apparatus of claim 1, the annular space having a width of approximately 10 to 15 millimeters.

12. The apparatus of claim 1, the rotor further comprising elevations on the side of the cylindrical wall of the rotor facing the annular space for producing negative pressure thrusts behind themselves, in the direction of rotation, to cause the return flow of the accepted stock back through the screen cage and into the annular space to dilute the unaccepted stock therein.

13. The apparatus of claim 12 the rotor being mounted concentrically within the screen cage, the return flow through the screen cage being inwardly toward the annular space.

14. The apparatus of claim 1, in combination with a vortex cleaner, said vortex cleaner generating a vertically upward flow of fibrous suspension to be sorted, the rotor having a vertically oriented axis and being mounted concentrically within the screen cage above the vortex cleaner and substantially coaxially with the flow of suspension from the vortex cleaner, the rotor further comprising a base at its lower end, said other end of the annular space in flow communication with the unaccepted stock outlet being the upper end of the annular space, the means connecting the inlet directly to the other end of the annular space comprising portions of the rotor forming an opening for the suspension leaving the vortex cleaner through the base of the rotor in flow communication with said other end of the annular space for the dilution of the unaccepted stock.

15. The apparatus of claim 14, the portions of the rotor forming an opening through the base of the rotor comprising a centrally located nozzle.

16. The apparatus of claim 15, the top of the rotor being open, the cylindrical wall and the base of the rotor being closed apart from the central nozzle.

17. The apparatus of claim 14, the nozzle protruding downwardly from the base.

18. An apparatus for sorting fiber suspensions comprising:

a stationary cylindrical screen cage;

a rotor having a cylindrical wall mounted concentrically relative to the screen cage, the screen cage and said rotor forming an annular space therebetween, the rotor further comprising portions forming openings in at least a portion of the cylindrical wall of this rotor;

an inlet for fiber suspension to be sorted, the inlet being in flow communication with one end of said annular space to introduce fibrous suspension to be sorted into said one end of the annular space, the fibrous suspension within the annular space flowing generally toward the other end of said annular space, a portion of the suspension within the annular space passing through the screen cage as accepted stock, the suspension within the annular space and that passing from said other end thereof being unaccepted stock, the action of the rotor causing the unaccepted stock within the annular space to increase in consistency as it flows toward said other end of the annular space, the inlet for fiber suspension to be sorted further being in direct flow communication with the side of cylindrical wall of the rotor opposite the annular space, whereby fibrous suspension to be sorted is introduced to the side of the rotor opposite the annular space and passes through the openings in the rotor into the annular space to dilute the unaccepted stock in the annular space to a lower consistency;

an accepted stock outlet in the flow communication with the side of said screen cage opposite the annular space; and an unaccepted stock outlet in flow communication with at least said other end of the annular space.

19. An apparatus for sorting fiber suspensions comprising:

a vortex cleaner, said vortex cleaner generating a vertically upward flow of fibrous suspension to be sorted;

a stationary cylindrical screen cage mounted concentric with and at the upper end of the vortex cleaner;

a rotor having a vertically oriented axis and a cylindrical wall mounted concentrically relative to the screen cage, the screen cage and said rotor forming an annular space therebetween, the rotor further comprising a base at its lower end, portions of the rotor forming an opening through the base of the rotor in flow communication with the upper end of the annular space, the opening being substantially coaxial with the flow of suspension from the vortex cleaner, fibrous suspension to be sorted flowing upwardly from the vortex cleaner into the lower end of the annular space, the fibrous suspension within the annular space flowing generally toward the upper of said annular space, a portion of the suspension within the annular space passing through the screen cage as accepted stock, the suspension within the annular space and that passing from said other end thereof being unaccepted stock, the action of the rotor causing the unaccepted stock within the annular space to increase in consistency as it flows toward said other end of the annular space, fibrous suspension to be sorted passing through the opening to the other end of the annular space for the dilution of the unaccepted stock;

an accepted stock outlet in flow communication with the side of said screen cage opposite the annular space; and an unaccepted stock outlet in flow communication with at least said upper end of the annular space.

* * * * *

UNITED STATES PATENT OFFICE

CERTIFICATE OF CORRECTION

Patent No. 4,202,761 Dated May 13, 1980

Inventor(s) Emil Holz

It is certified that error appears in the above-identified patent and that said Letters Patent are hereby corrected as shown below:

Column 5, line 31, delete "are" and substitute --and--;

Claim 5, line 1, delete "1" and substitute --4 or 18--.

Signed and Sealed this

*Nineteenth* Day of *August 1980*

[SEAL]

*Attest:*

SIDNEY A. DIAMOND

*Attesting Officer*

*Commissioner of Patents and Trademarks*